US008737176B2

(12) United States Patent
Bas et al.

(10) Patent No.: US 8,737,176 B2
(45) Date of Patent: May 27, 2014

(54) GOING TRAIN FOR A TIMEPIECE

(75) Inventors: Kewin Bas, Villers-le-Lac (FR); Cyrille Chatel, La Chenalotte (FR)

(73) Assignee: Cartier Creation Studio SA, Geneva (CH)

( * ) Notice: Subject to any disclaimer, the term of this patent is extended or adjusted under 35 U.S.C. 154(b) by 138 days.

(21) Appl. No.: 13/450,506

(22) Filed: Apr. 19, 2012

(65) Prior Publication Data

US 2012/0269044 A1 Oct. 25, 2012

(30) Foreign Application Priority Data

Apr. 20, 2011 (EP) ..... 11003306

(51) Int. Cl.
*G04B 15/00* (2006.01)

(52) U.S. Cl.
USPC ..... 368/220

(58) Field of Classification Search
USPC ..... 368/15–20, 28, 31–38, 127–131, 220
See application file for complete search history.

(56) References Cited

U.S. PATENT DOCUMENTS

| | | | | | |
|---|---|---|---|---|---|
| 2,490,783 | A * | 12/1949 | Cullen | 434/401 |
| 3,104,517 | A * | 9/1963 | Wuthrich | 368/148 |
| 4,428,682 | A * | 1/1984 | Winter | 368/238 |
| 5,103,434 | A * | 4/1992 | Sullivan | 368/238 |
| 5,359,578 | A * | 10/1994 | Truini | 368/76 |
| 7,535,802 | B2 * | 5/2009 | Pellaton | 368/28 |
| 7,630,277 | B2 * | 12/2009 | Conus et al. | 368/220 |
| 2007/0091728 | A1 * | 4/2007 | Girardin et al. | 368/142 |
| 2008/0205200 | A1 * | 8/2008 | Spode et al. | 368/172 |
| 2011/0051562 | A1 * | 3/2011 | Blondeau et al. | 368/80 |

FOREIGN PATENT DOCUMENTS

FR 1 457 818 1/1967

* cited by examiner

*Primary Examiner* — Amy Cohen Johnson
*Assistant Examiner* — Matthew Powell
(74) *Attorney, Agent, or Firm* — Young & Thompson

(57) ABSTRACT

The going train for a timepiece has a mechanical movement having a frame (0), a barrel (1) and an escapement pinion (5) which are connected by the going train. This going train has a stepping-up epicyclic train having a first planet gear (6) with a constant rotational speed during normal operation of the movement, a second planet gear (7) kinematically connected to the escapement pinion (5), at least one satellite gear (9) each meshing with the first planet gear (6) and the second planet gear (7), and a satellite carrier (8) kinematically connected to the barrel (1) and carrying the satellite gear(s) (9).

20 Claims, 3 Drawing Sheets

GOING TRAIN FOR A TIMEPIECE

The present invention relates to the going train of a timepiece, i.e. to the going train connecting the barrel of the mechanical timepiece movement to the escapement pinion of this movement.

Document FR 1 457 818 describes a simplification made to the going train used in an automatic watch. According to this document, the oscillating mass controls a differential device actuating, on the one hand, the going train directly and, on the other hand, the mainspring. The differential device has a differential planetary gear train having a first internal planet gear connected to the oscillating mass, a second external planet gear connected to the going train, a satellite carrier connected to the mainspring, and three satellite gears. Since this differential device is inserted after the mainspring and before the last going train mobile, it is involved in both the stepping-down of the winding going train and in the stepping-up of the going train. In spite of this simplification, the going train of this watch, and in particular its gear train, still incorporate a large number of mobiles.

The aim of the present invention is principally to increase the output of the stepping-up gear train by transmitting the motive force from the barrel to the escapement. Another aim of the invention is to reduce the number of mobiles in the going train of a mechanical timepiece movement and, secondarily, to allow new aesthetic possibilities to be envisaged for a mechanical timepiece movement. Finally, an additional aim of the invention is to omit the gears of the motion work, which also makes it possible to increase the output and to reduce the number of mobiles and thus to reduce the volume of the gear trains in a mechanical timepiece movement.

The object of the present invention is thus a going train for a timepiece having a mechanical movement having a barrel and an escapement pinion, which is characterised by the fact that it has an epicyclic train (also called a planetary gear train) formed from a first and a second planet gear, a satellite carrier and at least one satellite gear.

The first planet gear is rotationally driven at a constant speed and it is preferably fixed with respect to the frame of the movement, this constant speed being zero. The satellite carrier has a wheel meshing directly with toothing of the barrel, the at least one satellite gear has a wheel in engagement with a pinion of the second planet gear and a pinion in engagement with the first fixed planet gear, the second planet gear also having a wheel kinematically connected to the escapement pinion.

In one particular embodiment of the going train, the wheel of the second planet gear is connected to the escapement pinion by a single intermediate mobile.

The stepping-up ratios of the going train are preferably such that the satellite carrier of the epicyclic train effects one turn per hour.

Finally, in one particular embodiment, the barrel of the movement has second toothing directly engaged with an hour wheel effecting one turn in twelve hours.

The attached drawing schematically illustrates, by way of example, a particular embodiment of the going train in accordance with the invention.

Figure 1:
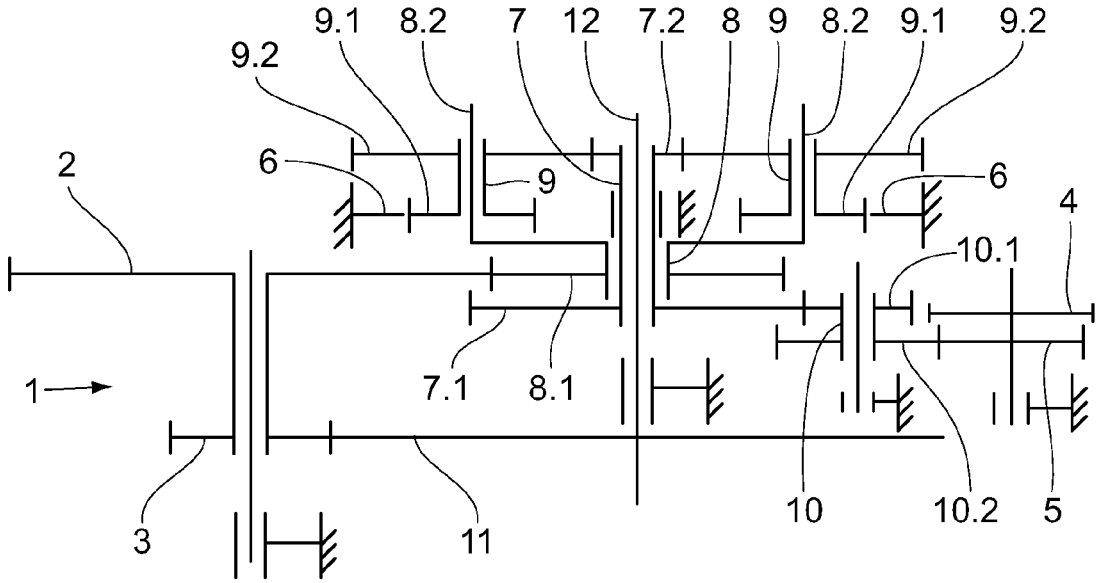
FIG. 1 is a schematic illustration of the barrel, of the escapement pinion of a mechanical timepiece movement and of the going train in accordance with the invention.
Figure 2:
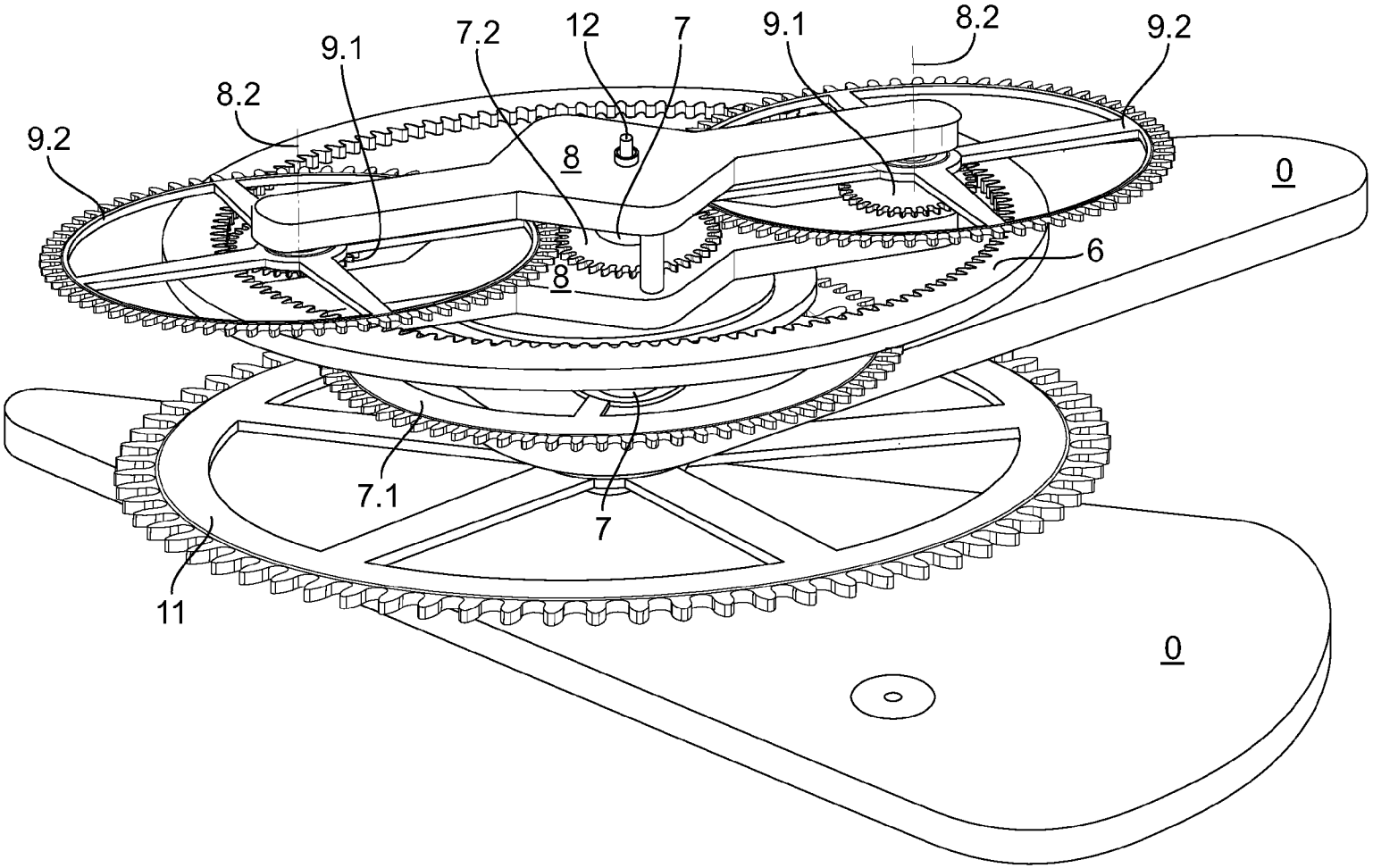
FIG. 2 is a perspective view of the epicyclic train of the going train.
Figure 3:
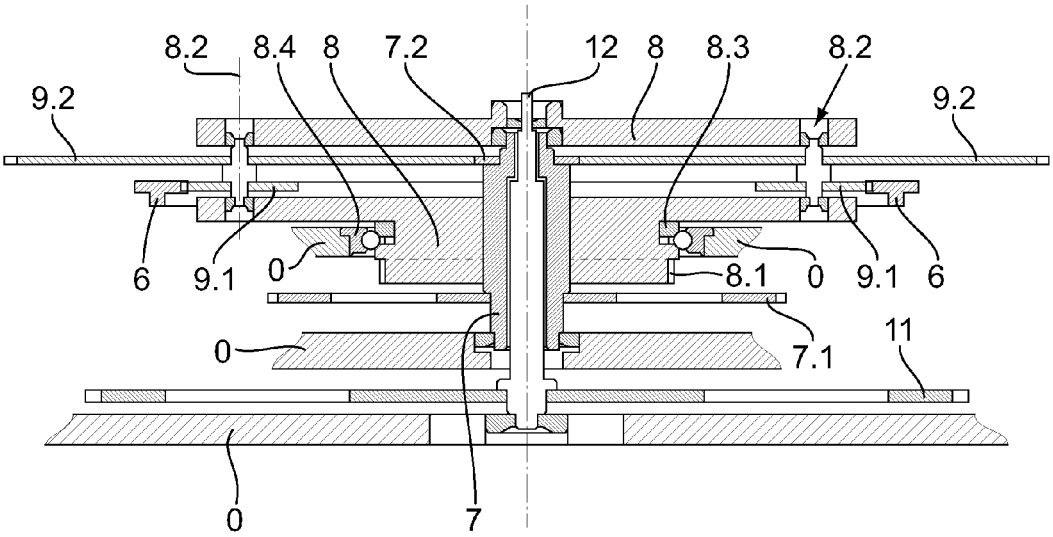
FIG. 3 is a cross-sectional view through the axis of the epicyclic train of the finishing gear train.

The object of the present invention is a going train for a movement of a mechanical timepiece. The term "going train" is understood to mean the gear train connecting the barrel of the movement to the escapement pinion of the said timepiece movement.

The particular feature of the going train in accordance with the invention resides in the fact that it has an epicyclic train, which makes it possible to achieve a large stepping-up ratio while using few mobiles.

This epicyclic train has a satellite carrier having a wheel directly engaged with toothing of the barrel of the timepiece movement. This satellite carrier has at least one satellite gear having a pinion in engagement with a first planet gear, the rotational speed of which is constant (preferably zero) during normal operation of the movement, and a wheel in engagement with a pinion of a second planet gear, the wheel of which is directly or indirectly connected to the escapement pinion of the movement.

A particular feature of this going train resides in the fact that the numbers of teeth of the different mobiles which it comprises are determined depending on the frequency of the regulating member, e.g. a spiral balance, of the movement so that the satellite carrier effects one turn per hour. By reason of this, this satellite carrier can directly carry the minute hand of the timepiece.

This then permits omission of the traditional motion work of the timepiece movement owing to the provision of second toothing on the barrel meshing with an hour wheel.

It is thus clearly seen that a going train of this type has a smaller number of mobiles, which makes possible a significant increase in the output of the going train and a reduction in the volume thereof.

Reference to the attached drawing shows that the mechanical timepiece movement has a barrel 1 pivoted on the bottom plate of the movement, the drum of which has first toothing 2 and second toothing 3. The movement also has a regulating member, not shown, cooperating with an escapement mobile having an escapement wheel 4 fixedly attached to an escapement pinion 5 pivoted on the bottom plate or a bridge of the movement.

The going train of the timepiece movement which will now be described constitutes the kinematic connection between the escapement pinion 5 and the first toothing 2 of the barrel 1.

In the illustrated example, this going train has an epicyclic train and an intermediate mobile.

In the illustrated example, the epicyclic train has a first planet gear 6 formed by an internally toothed crown which is fixed during normal operation of the movement. It also has a second planet gear 7 pivoted on a fixed part of the movement concentrically with respect to the first planet gear 6 and having a wheel 7.1 of the second planet gear 7 and a pinion 7.2 of the second planet gear 7 acting as a sun wheel in the epicyclic train.

This epicyclic train also has a satellite carrier 8 having a satellite carrier wheel 8.1 directly engaged with the first toothing 2 of the barrel 1, and at least one eccentric axis 8.2 parallel to the axis of rotation of the satellite carrier wheel 8.1, about which is pivoted a satellite gear 9 having a satellite pinion 9.1 in engagement with the first planet gear 6 and a satellite wheel 9.2 in engagement with the external toothing of the pinion 7.2 of the second planet gear 7. The satellite carrier 8 pivots concentrically and freely with respect to the planet gear 7 and to the axle 12 by means of a ball bearing, the internal ring 8.3 of which is fixedly attached to the satellite carrier 8 and the external ring 8.4 is fixedly attached to the frame 0 of the movement. In the illustrated example, the satellite carrier 8 has two eccentric axes 8.2 each serving as a pivot for a satellite gear 9.

In the illustrated example, the going train also has an intermediate mobile 10 pivoted on a fixed part of the movement on an axis parallel to the axis of the epicyclic train, having a pinion 10.1 in engagement with the wheel 7.1 of the second planet gear 7 and a wheel 10.2 in engagement with the escapement pinion 5 of the timepiece movement.

This going train is advantageously constructed in such a way that the satellite carrier 8 effects one full turn in an hour so that this satellite carrier can carry the minute hand of a time display of the timepiece equipped with such a going train.

In the illustrated example, and in order to obtain a rotation of one turn per hour of the satellite carrier 8, the number of teeth of the various mobiles of the going train is as indicated below by way of non-limiting example for a regulating member with a frequency of 4 Hz:

first toothing 2 of the barrel 1, 123 teeth
wheel 8.2 of satellite carrier 8, 41 teeth
wheel 9.2 of satellite gear 9, 88 teeth
pinion 9.1 of satellite gear 9, 22 teeth
crown 6 of first planet gear, 132 teeth
pinion 7.2 of second planet gear 7, 22 teeth
wheel 7.1 of second planet gear 7, 88 teeth
pinion 10.1 of intermediate mobile 10, 20 teeth
wheel 10.2 of intermediate mobile 10, 112 teeth
escapement pinion 5, 21 teeth
escapement wheel 4, 20 teeth A going train of this type has only a few mobiles owing to the high stepping-up ratio of the epicyclic train, which makes it possible to reduce the volume thereof as well as its energy consumption.

In the illustrated example, the going train also has an hour wheel 11, the axle 12 of which extends concentrically through the axis of the second planet gear 7 and carries an hour hand for the time display of the timepiece fitted with this going train. This hour wheel 11 meshes directly with the second toothing 3 of the barrel 1. In this example, the bearing of the satellite carrier 8 is first mounted on the frame, and then the shaft of the planet gear 7 and, subsequently, the axle 12 are mounted on the bridge side so that they pivot downwards in their respective bridges (fixed to the bottom plate) and upwards in the satellite carrier 8. Other mounting variations are naturally possible.

In the case of the particular example indicated above, the number of teeth of the second toothing 3 is 30 teeth and that of the hour wheel 11 is 120 teeth so that the said hour wheel 11 effects one turn in twelve hours.

In one variation, it would be possible for the going train not to have an intermediate mobile 10, the wheel 7.1 of the second planet gear 7 then meshing directly with the escapement pinion 5. The number of teeth in the mobiles of the epicyclic train would then be determined so that the satellite carrier 8 still effects one turn per hour. More generally, and also depending on the torque available to the barrel and for provision to the escapement, it would also be possible for the going train to have two or more additional mobiles. It should be noted that the going train described above does not have a motion work gear train, which further reduces its volume and increases the output of the said going train. In order to set the time on the time display, the planet gear 6, which, in the illustrated example, is fixed during normal operation of the movement, can be rotated by the user (e.g. when the movement is stopped) by means of a time-setting mechanism.

The time-setting mechanism has a kinematic link connecting the winding stem of the movement, when it is in the pulled time-setting position, to the first planet gear 6 rotationally mounted on the frame 0 of the movement. Thus one rotation of this winding stem in the time-setting position drives the satellite carrier 8 and thus the hour hand which it carries. When the satellite carrier 8 is turned during time setting, the axle of the barrel 1 is rotationally driven in one direction or the other. This barrel axle being connected to the hour hand, this makes it possible to set the time with the hour hand.

In order to avoid unwinding and rewinding the barrel spring during time setting, it is possible in one variation to provide a disconnecting system between the mobile which meshes with the satellite carrier 8 and the hour mobile 11 on the one hand and the barrel spring on the other.

In one variation, the rotational speed of the satellite carrier 8 is one turn every two hours and the minutes indicator has a marker semi-circle cooperating with a double hand, which still makes it possible to omit the motion work. However, in other variations where the rotational speed of the satellite carrier 8 is different, it is generally necessary to add the motion work for the display. In this case, in order to ensure that the associated time-setting system functions, it is necessary to connect the motion work onto the satellite carrier or upstream thereof.

In another variation of the going train the stepping-up ratio between the second toothing 3 of the barrel 1 and the hour wheel 11 can be such that this hour wheel 11 effects one full turn in twenty four hours.

As described above, the first planet gear 6 is fixed during normal operation of the movement. In variations, the epicyclic train can be configured so that the first planet gear turns at a constant speed during normal operation of the movement but in general a zero speed is preferential for simplicity of design. In any case, it is essential for the first planet gear not to be controlled by an external influence such as the movements of an oscillating mass.

Although in the illustrated embodiment the configuration of a first external planet gear 6 which is of constant speed (and preferably fixed) and a second internal planet gear 7 connected to the escapement has been chosen for its ease of design and its saving in volume, other variations of the epicyclic train are also possible. For example, two internal planet gears or two external planet gears can be used. It is possible to have one epicyclic train with two internal planet gears, without an external planet gear, or with two external planet gears and without an internal planet gear. Furthermore, it would be possible to place a first planet gear which is of constant speed (preferably fixed) on the inside and a second planet gear connected to the escapement on the outside.

The invention claimed is:

1. A going gear train for a timepiece movement having a frame (0), a barrel (1), and an escapement pinion (5), the going gear train connects the barrel to the escapement pinion and comprises a stepping-up epicyclic train having a first planet gear (6), a second planet gear (7) connected kinematically to the escapement pinion (5), at least one satellite gear (9) meshing with the first planet gear (6) and the second planet gear (7), and a satellite carrier (8) connected kinematically to the barrel (1) and carrying the satellite gear(s) (9), wherein the satellite carrier (8) effects one full turn per hour.

2. The going gear train as claimed in claim 1, wherein the first planet gear (6) has a crown having internal toothing meshing with each satellite gear (9) and the second planet gear (7) has a wheel with external toothing meshing with each satellite gear (9).

3. The going gear train as claimed in claim 2, wherein the satellite carrier (8) has a satellite carrier wheel (8.1) meshing directly with a first toothing (2) of the barrel (1).

4. The going gear train as claimed in claim 2, further comprising at least one intermediate mobile (10) between the wheel (7.1) of the second planet gear (7) and the escapement pinion (5) of the movement.

5. The going gear train as claimed in claim 2, further comprising an hour wheel (11) carried by an axle passing coaxially through the epicyclic train, this hour wheel being in direct engagement with a second toothing (3) of the barrel (1) of the movement and effecting one full turn in twelve hours or twenty four hours.

6. The going gear train as claimed in claim 2, wherein the first planet gear (6) has a speed of zero and is thus fixed with respect to the frame (0) of the movement during normal operation of the movement.

7. The going gear train as claimed in claim 2, wherein the first planet gear (6) is rotationally mounted on the frame (0) of the movement and is kinematically connected to a winding stem which the said movement comprises when this winding stem is in the time-setting position.

8. The going gear train as claimed in claim 1, wherein the satellite carrier (8) has a satellite carrier wheel (8.1) meshing directly with a first toothing (2) of the barrel (1).

9. The going gear train as claimed in claim 1, further comprising at least one intermediate mobile (10) between the wheel (7.1) of the second planet gear (7) and the escapement pinion (5) of the movement.

10. The going gear train as claimed in claim 1, further comprising an hour wheel (11) carried by an axle passing coaxially through the epicyclic train, this hour wheel being in direct engagement with a second toothing (3) of the barrel (1) of the movement and effecting one full turn in twelve hours or twenty four hours.

11. The going gear train as claimed in claim 1, wherein the first planet gear (6) is rotationally mounted on the frame (0) of the movement and is kinematically connected to a winding stem which the said movement comprises when this winding stem is in the time-setting position.

12. A timepiece comprising the going gear train as claimed in claim 1.

13. The timepiece as claimed in claim 12, further comprising a time display having a minute hand carried by the satellite carrier (8) of the epicyclic train of the going gear train.

14. The timepiece as claimed in claim 13, wherein the time display has an hour hand driven by an hour wheel (11) meshing directly with second toothing (3) of the barrel (1) of the movement.

15. The movement as claimed in claim 1, wherein the first planet gear (6) has a crown having internal toothing meshing with each satellite gear (9) and the second planet gear (7) has a wheel with external toothing meshing with each satellite gear (9).

16. A timepiece movement having a frame (0), a barrel (1), an escapement pinion (5) and a going train, the going train comprising a stepping-up epicyclic train having a first planet gear (6), a second planet gear (7) connected kinematically to the escapement pinion (5), at least one satellite gear (9) meshing with the first planet gear (6) and the second planet gear (7), and a satellite carrier (8) connected kinematically to the barrel (1) and carrying the satellite gear (9), wherein the satellite carrier (8) effects one full turn per hour, wherein the satellite carrier (8) has a satellite carrier wheel (8.1) meshing directly with a first toothing (2) of the barrel (1), and wherein each satellite gear (9) has a satellite pinion (9.1) in engagement with the first planet gear (6) and a satellite wheel (9.2) in engagement with a pinion (7.2) of the second planet gear (7), this second planet gear (7) having a second planet gear wheel (7.1) kinematically connected to the escapement pinion (5) of the movement.

17. The movement as claimed in claim 16, wherein the satellite carrier (8) carries two satellite gears (9).

18. A timepiece movement having a frame (0), a barrel (1), an escapement pinion (5) and a going train, the going train comprising a stepping-up epicyclic train having a first planet gear (6), a second planet gear (7) connected kinematically to the escapement pinion (5), at least one satellite gear (9) meshing with the first planet gear (6) and the second planet gear (7), and a satellite carrier (8) connected kinematically to the barrel (1) and carrying the satellite gear (9), wherein the satellite carrier (8) effects one full turn per hour, and wherein the first planet gear (6) has a speed of zero and is thus fixed with respect to the frame (0) of the movement during normal operation of the movement.

19. The movement as claimed in claim 18, wherein the satellite carrier (8) has a satellite carrier wheel (8.1) meshing directly with a first toothing (2) of the barrel (1).

20. The movement as claimed in claim 18, further comprising at least one intermediate mobile (10) between the wheel (7.1) of the second planet gear (7) and the escapement pinion (5) of the movement.

* * * * *